US007194823B2

(12) United States Patent
Nakamoto et al.

(10) Patent No.: US 7,194,823 B2
(45) Date of Patent: Mar. 27, 2007

(54) CLOTHES DRIER

(75) Inventors: Shigeharu Nakamoto, Hyogo (JP); Hidetaka Yabuuchi, Hyogo (JP); Hajime Nojima, Hyogo (JP); Masayuki Tanaka, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/999,945

(22) Filed: Dec. 1, 2004

(65) Prior Publication Data

US 2005/0120577 A1 Jun. 9, 2005

(30) Foreign Application Priority Data

Dec. 8, 2003 (JP) ..... 2003-408593
Aug. 26, 2004 (JP) ..... 2004-246658

(51) Int. Cl.
*F26B 21/00* (2006.01)
*F26B 21/06* (2006.01)

(52) U.S. Cl. ..... 34/526; 34/73; 34/77; 34/562; 34/572; 34/134; 34/606

(58) Field of Classification Search ..... 34/73, 34/74, 77, 78, 83, 84, 86, 130, 131, 132, 34/595, 599, 139, 602, 604, 526, 562
See application file for complete search history.

(56) References Cited

U.S. PATENT DOCUMENTS 4,142,375 A 3/1979 Abe et al.
4,621,438 A 11/1986 Lanciaux
2005/0044744 A1* 3/2005 Tadano et al. ..... 34/596

FOREIGN PATENT DOCUMENTS

DE 04028698.1 4/2005
EP 1209277 5/2002
JP 07174441 A * 7/1995
JP 08-182897 7/1996

* cited by examiner

*Primary Examiner*—Jiping Lu
(74) *Attorney, Agent, or Firm*—Bacon & Thomas, PLLC

(57) ABSTRACT

A clothes drying apparatus includes a heat pump mechanism, an air path for guiding drying air into a drying drum accommodating therein clothes, a blower for supplying drying air to the air path, and a controller for controlling a driving of a compressor, wherein the controller operates the blower and the compressor during a drying operation; stops the compressor in case the drying operation is suspended; and operates, in case the drying operation is resumed, the compressor after a certain time period has elapsed since the compressor had stopped. In case employing the heat pump mechanism having the compressor as a heat source, it is possible to reduce a load on the compressor and allow temperature of warm air to rapidly return by using the heat pump mechanism.

9 Claims, 15 Drawing Sheets

CLOTHES DRIER

FIELD OF THE INVENTION

The present invention relates to a clothes drying apparatus included in a clothes drier for drying clothes or the like, or a washing and drying machine for washing and drying clothes in a same tub.

BACKGROUND OF THE INVENTION

In a conventional clothes drier, in case clothes are put into or taken out during a drying process or the like, a drying operation is suspended by opening/closing a door and the drying process is temporarily stopped, wherein all of a heating device, a blowing device and agitation blades are stopped (see, e.g., Japanese Patent Laid-open Publication No. H8-182897). FIG. 18 shows the conventional clothes drier disclosed therein. As illustrated in FIG. 18, the conventional clothes drier includes rotary drum 1 serving as a drying drum for accommodating and drying clothes and agitation blades; heat transfer fan having wings on both sides 2 for circulating warm air in rotary drum 1; self temperature control type PTC heater 3 serving as a heating device provided in a blowing route toward rotary drum 1; door 4 for blocking an opening of rotary drum 1; motor 5 for rotatively driving rotary drum 1 and heat transfer fan having wings on both sides 2; opening/closing detector 7 for detecting an opening and a closing of door 4; and controller 6 for controlling an operation of PTC heater 3 and motor 5. In case opening/closing detector 7 detects opening of door 4, controller 6 stops the power supplying to PTC heater 3 and motor 5. On the other hand, in case closing of door 4 is detected, the power supplying to PTC heater 3 and motor 5 is resumed after a certain time period.

In such a conventional configuration, an electric heater which is capable of raising temperature rapidly is effective as a heat source. However, in case a heat pump mechanism including a compressor is employed as a heat source, raising temperature by the compressor is slow in comparison with a case of the electric heater and, further, it is difficult to return to an original temperature of warm air. Furthermore, a pressure difference of a coolant in a refrigerating cycle of the heat pump mechanism becomes large shortly after the compressor stops, and a repeated stop and start during a short time period may lead to a starting failure of the compressor. Accordingly, it is desirable and necessary to have a configuration capable of preventing repeated stopping and restarting of the compressor during a short time period accompanied by suspending and resuming of a drying operation.

SUMMARY OF THE INVENTION

The present invention has been developed in order to solve the aforementioned drawbacks efficiently.

It is, therefore, an object of the present invention to provide a clothes drying apparatus capable of reducing a load on a compressor by avoiding a frequently repeated stop and restart of the compressor during a short time period even in case a heat pump mechanism including the compressor is employed as a heat source, and allowing the temperature of warm air to rapidly return by using the heat pump mechanism, wherein the clothes drying apparatus can handle a suspension of the drying operation during a drying process, an opening/closing of a door and a loading/unloading of clothes, all of which are unique characteristics of using a drying apparatus in order to, e.g., check a dried state of clothes during the drying process, take out dried clothes or easily wrinkled clothes and add clothes to be dried during the drying process.

The present invention includes a heat pump mechanism; an air path for guiding drying air into a drying drum accommodating therein clothes; a blower for supplying drying air to the air path; and a controller for controlling a driving of a compressor. The controller operates the blower and the compressor during a drying operation and stops the compressor in case the drying operation is suspended; and in case of resuming the drying operation, the controller enables the compressor to be operated only after a preset time period has elapsed since the compressor was stopped.

Due to such delay time period of suspension, it is possible to avoid the frequently repeated stop and start of the compressor during a short time period and reduce a load on the compressor, thereby reducing the effect of a suspension of a drying operation during a drying process.

A clothes drying apparatus of the present invention reduces a load on a compressor even in case a heat pump mechanism having the compressor serving as a heat source is employed, thereby reducing the effect of a suspension of a drying operation.

In accordance with the present invention, there is provided a clothes drying apparatus including: a heat pump mechanism including a compressor, a heat radiator for radiating heat of a compressed coolant at a high pressure and a high temperature, a throttle unit for depressurizing the high-pressure coolant, and a heat absorber for absorbing heat from surroundings by using the depressurized low-pressure coolant, wherein the compressor, the heat radiator, the throttle unit and the heat absorber being connected to each other by a pipeline to allow the coolant to be circulated; an air path for guiding drying air to the heat absorber, the heat radiator, and a drying drum having therein clothes; a blower for blowing the drying air to the air path; and a controller for controlling driving of the compressor, wherein the controller operates the blower and the compressor during a drying operation and stops the compressor in case the drying operation is suspended; and in case of resuming the drying operation, the controller enables the compressor to be operated only after a predetermined delay time period has elapsed since the compressor was stopped.

Since the compressor has a certain delay time period, time can be made available until a pressure difference of the coolant decreases after compressor has stopped. Accordingly, a load on compressor is reduced, and a frequently repeated stop and restart of compressor during a short time period can be avoided, thereby reducing the effect of the suspension of the drying operation.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Hereinafter, preferred embodiments of the present invention will be described with reference to the accompanying drawings. Further, the present invention is not limited to the preferred embodiments.

(First Preferred Embodiment)

Figure 1:
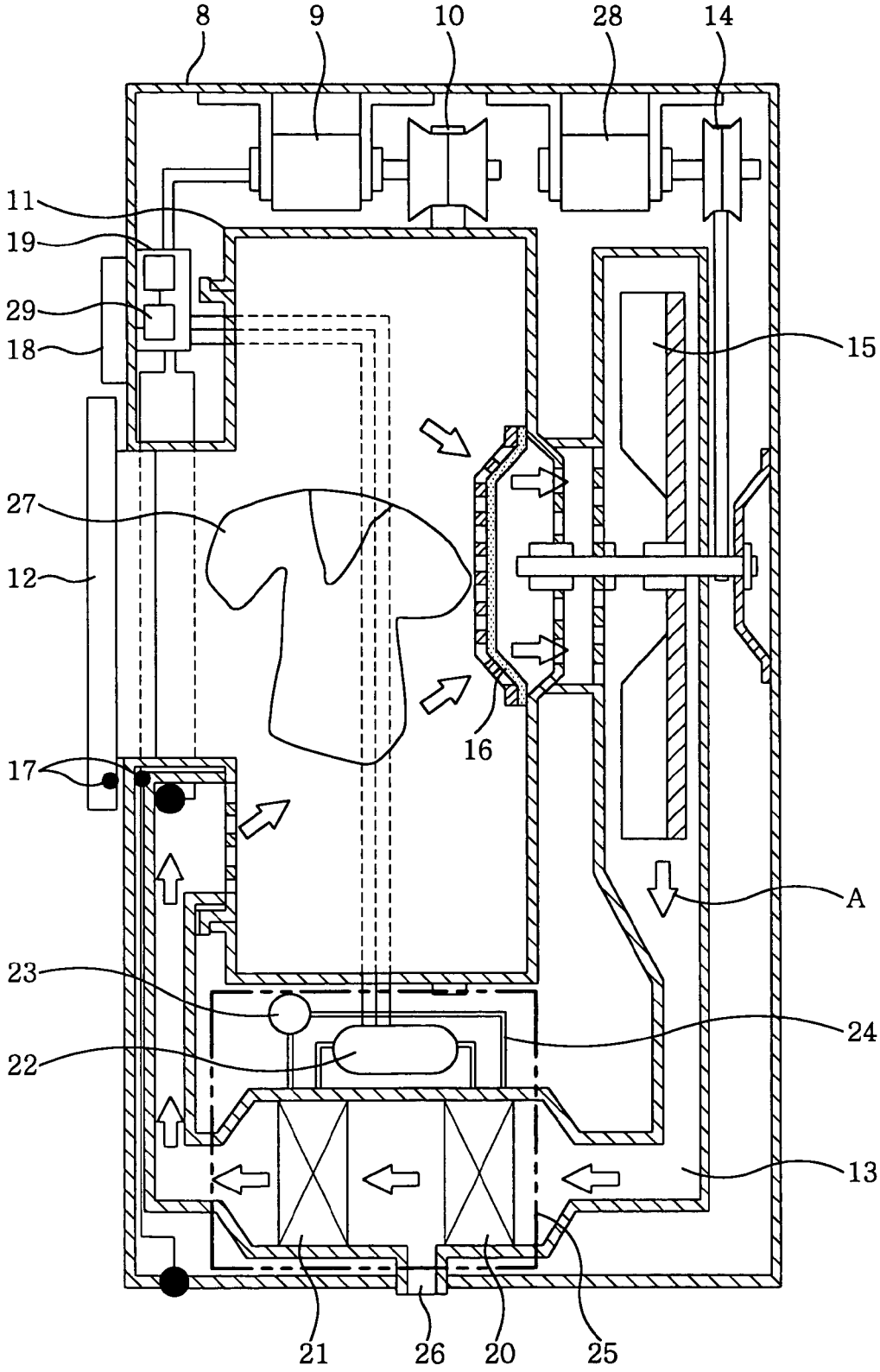
FIG. 1 is a side sectional view of a clothes drier in accordance with a first preferred embodiment of the present invention.

FIG. 1 illustrates a side sectional view of a clothes drier including a clothes drying apparatus in accordance with a first preferred embodiment of the present invention. Referring to FIG. 1, there is illustrated heat pump mechanism 25 including: compressor 22 for compressing a coolant; heat radiator 21 for radiating heat of the compressed coolant at a high pressure and a high temperature; throttle unit 23, e.g., a capillary tube or the like, for maintaining a pressure difference of the coolant by depressurizing the high-pressure coolant; and heat absorber 20 for absorbing heat from the surroundings by using the depressurized low-pressure coolant, those being sequentially connected to each other by pipeline 24 to allow the coolant to be circulated.

Drying air is guided from rotary drum 11 serving as a drying drum accommodating therein clothes 27 and agitation blades to heat absorber 20 and heat radiator 21 of heat pump mechanism 25 by blower 15 via air path 13. The drying air is cooled and dehumidified in heat absorber 20. Further, the drying air is reheated in heat radiator 21 and then sent to rotary drum 11. Lint filter 16 is attached to a rear central portion of rotary drum 11, and captures dusts in the drying air.

Rotary drum 11 is rotatably provided in drier main body 8 and, further, operated by motor 9 via drum belt 10. Blower 15 is rotated by additional motor 28 instead of motor 9, for moving rotary drum 11 via belt 14, wherein blower 15 and rotary drum 11 are independently movable. Further, in case their independent movement is unnecessary, it is possible to have a configuration in which blower 15 and rotary drum 11 are simultaneously operated by motor 9 as in the conventional example.

Drain outlet 26 provided near heat absorber 20 in the middle of air path 13 discharges condensed water of the drying air, the condensed water being generated by a heat exchange in heat absorber 20. Clothes 27 are put into and taken out through door 12 provided at a front surface of drier main body 8.

Opening/closing detector 17 for detecting an opening/closing of door 12 has, e.g., a magnet adhered to door 12 and a reed switch provided as a magnetic sensor at drier main body 8, and detects the opening/closing of door 12 based on a change of magnetism due to a movement of the magnets. In case door 12 is opened during a drying operation in order to put into and/or take out clothes 27, the drying operation is suspended. Further, in case door 12 is closed, the drying operation is resumed.

Further, a manipulating unit is provided with drying operation stop switch 18 together with various mode setting switches, e.g., a power switch, a start/stop switch of the drying operation, wherein the drying operation is suspended and resumed by manipulating drying operation stop switch 18.

Controller 19 operates blower 15 and compressor 22 during the drying operation and stops compressor 22 in case the drying operation is suspended; and in case of resuming the drying operation, controller 19 operates compressor 22 after a certain time period has elapsed since compressor 22 was stopped.

In case heat pump mechanism 25 is used, sensible heat and latent heat from drying air that has been in contact with to-be-dried clothes 27 are collected by heat absorber 20 and, further, such heat can be used for the heat capacity for heating the drying air again in heat radiator 21. Therefore, in comparison with a heating by an electric heater, the same amount of clothes can be dried for the same time period with a smaller input. Moreover, although the heat capacity that can be outputted from the electric heater is limited due to the current capacity of a household wall outlet, if heat pump mechanism 25 is used, a higher output can be obtained with a smaller input. Therefore, a reduction of drying time can also be achieved by carrying out a drying process with higher heating energy.

Hereinafter, an operation thereof will be described. First, to-be-dried clothes 27 are put into rotary drum 11 by opening/closing door 12. Then, door 12 is closed, and if a drying operation is started by manipulating a manipulation unit, motors 9 and 28 rotate and, thus, rotary drum 11 and blower 15 also rotate, thereby resulting in a generation of a draft A of drying air. The drying air absorbs moisture from clothes 27 in rotary drum 11 and becomes highly humid. Then, after passing through lint filter 16 and air path 13, the drying air is transferred to heat absorber 20 of heat pump mechanism 25.

Meanwhile, if the drying operation is started, compressor 22 operates and a coolant circulates due to a difference between a high and a low pressure of the coolant. In heat absorber 20, heat is absorbed by a low-temperature coolant and, thus, the drying air is dehumidified. Further, in heat radiator 21, the heat capacity from compressor 22 is added to that absorbed by heat absorber 20, thereby heating the drying air again by a heat radiation from a high-temperature coolant. Then, the drying air is circulated again in rotary drum 11, and the coolant is returned to compressor 22 via heat radiator 21, throttle unit 23 and heat absorber 20. By repeating such processes, clothes 27 become dry.

If door 12 is opened or the drying operation is suspended by manipulating drying operation stop switch 18 during the drying process, controller 19 stops compressor 22 and, further, at least one of motors 9 and 28 stops immediately or after a certain time period, or reduces its rotation number, thereby controlling blower 15 and rotary drum 11 serving as agitation blades. After a user adds or takes out clothes, if the drying operation is resumed by closing door 12 or manipulating drying operation stop switch 18, at least one of motors 9 and 28 operates immediately or increases its rotation number after a certain time period, thereby controlling blower 15 and rotary drum 11 serving as agitation blades.

Figure 2:
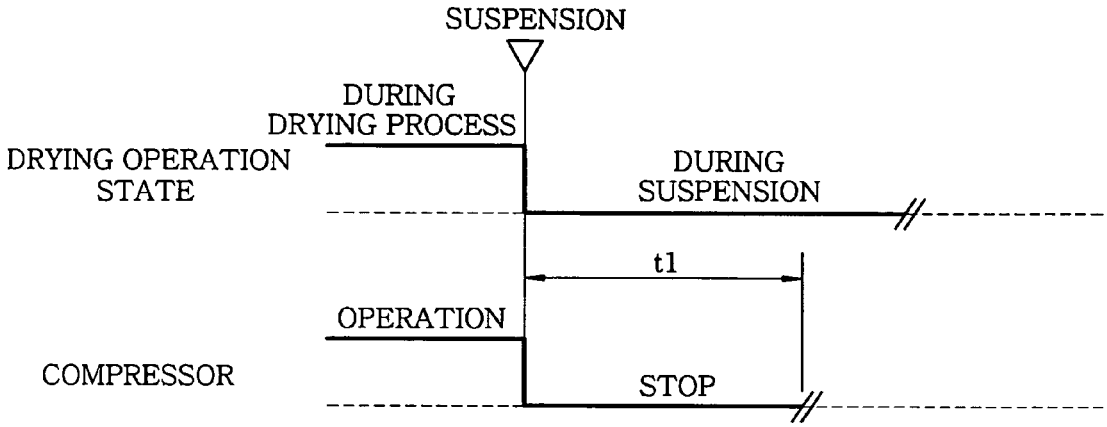
FIG. 2 shows a time chart illustrating an operation performed when a drying operation of the clothes drier in accordance with the first preferred embodiment of the present invention is suspended.

FIG. 2 shows a time chart illustrating an operation of compressor 22, which is performed when the drying operation is suspended and resumed. If the drying operation is suspended by opening door 12 or manipulating drying operation stop switch 18, controller 19 stops compressor 22. Further, in case a certain time period t1 has not elapsed since compressor 22 had stopped, compressor 22 is not be allowed to be operated.

As described above, since compressor 22 has a certain delay time period, time can be made available until a pressure difference of the coolant decreases after compressor 22 has stopped. Accordingly, a load on compressor 22 is reduced, and a frequently repeated stop and restart of compressor 22 during a short time period can be avoided, thereby reducing the effect of the suspension of the drying operation.

Although, in this preferred embodiment, the drying operation is suspended by, e.g., the drying operation stop switch or the opening/closing detector for detecting an opening/closing state of a door provided at a clothes loading opening of the drying drum, it is not limited thereto.

(Second Preferred Embodiment)

Figure 3:
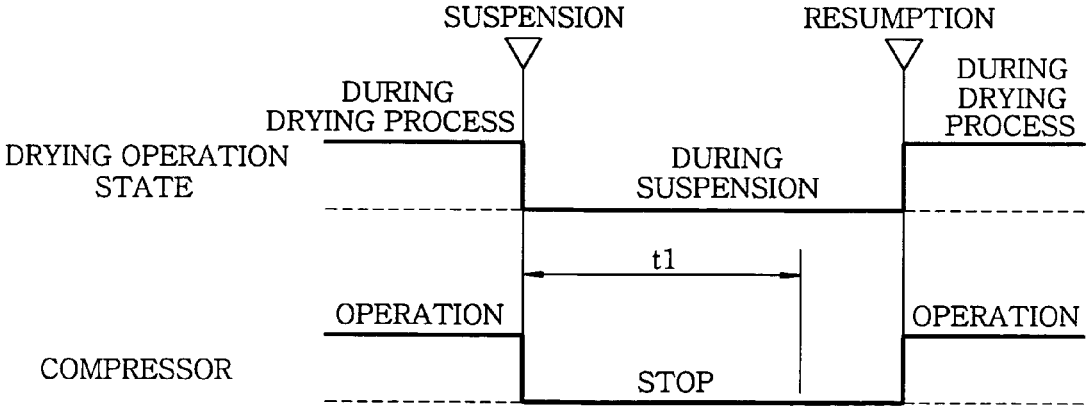
FIG. 3 depicts a time chart showing an operation performed when a drying operation of a clothes drier in accordance with a second preferred embodiment of the present invention is suspended.

FIG. 3 provides a time chart depicting an operation performed when a drying operation of a clothes drier including a clothes drying apparatus in accordance with a second preferred embodiment of the present invention is suspended. Since a basic operation and configuration of the clothes drier are the same as those of the first preferred embodiment, a detailed description thereof will be omitted.

Referring to FIG. 3, controller 19 resumes an operation of compressor 22 in case a first certain delay time period t1 has elapsed after compressor 22 had stopped and, further, in case the drying operation is resumed during the suspension of the drying operation.

Since compressor 22 has a certain delay time period, time can be made available until a pressure difference of the coolant decreases after compressor 22 has stopped. Accordingly, a load on compressor 22 is reduced, and a frequently repeated stop and restart of compressor 22 during a short time period can be avoided, thereby reducing the effect of the suspension of the drying operation.

(Third Preferred Embodiment)

Figure 4:
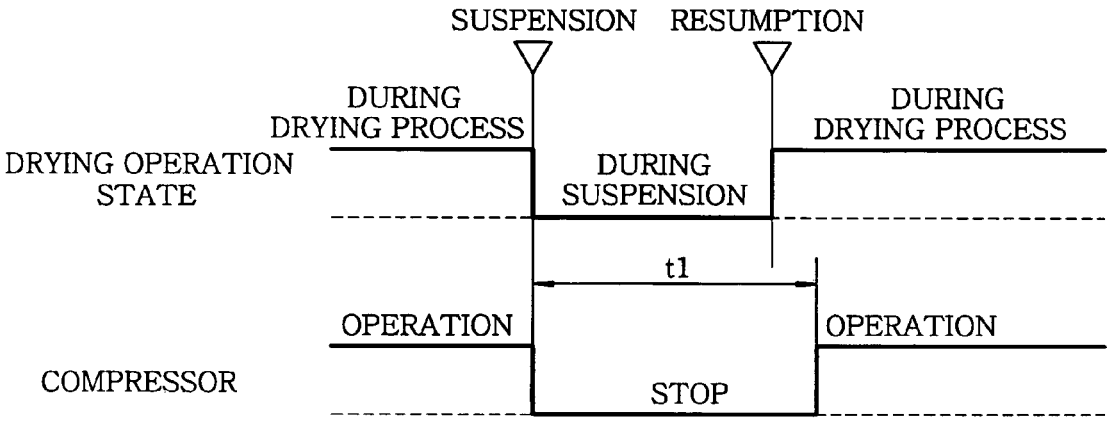
FIG. 4 describes a time chart depicting an operation performed when a drying operation of a clothes drier in accordance with a third preferred embodiment of the present invention is suspended.

FIG. 4 presents a time chart for illustrating an operation performed when a clothes drier including a clothes drying apparatus in accordance with a third preferred embodiment of the present invention is suspended. Since a basic operation and configuration of the clothes drier are the same as those of the first preferred embodiment, a detailed description thereof will be omitted.

Referring to FIG. 4, in case the drying operation is resumed before the first certain delay time period t1 has elapsed after compressor 22 had stopped, controller 19 operates compressor 22 after the first certain delay time period t1 has elapsed.

Since the first certain delay time period t1 of compressor 22 is provided, a load on compressor 22 is reduced, thereby reducing the effect of the suspension of the drying operation.

(Fourth Preferred Embodiment)

Figure 5:
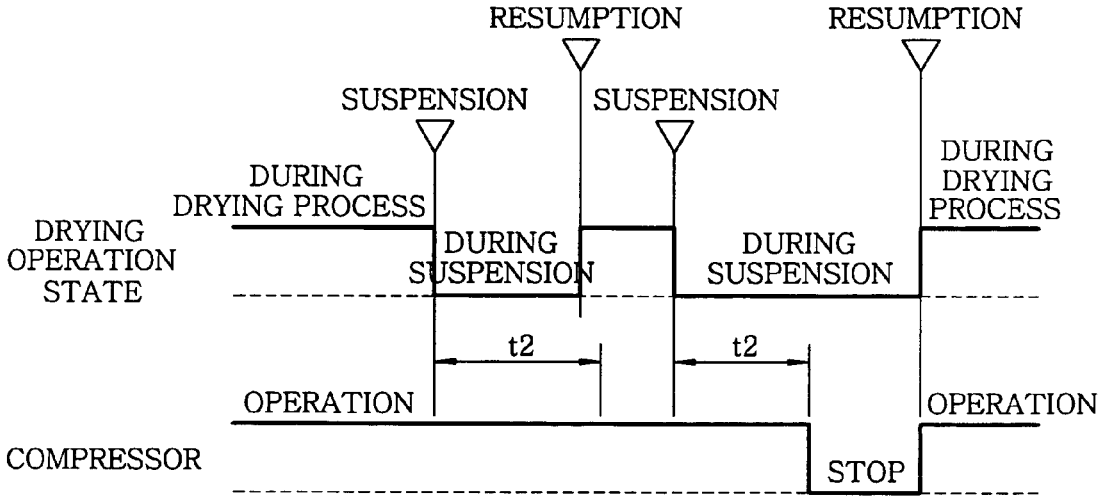
FIG. 5 provides a time chart illustrating an operation performed when a drying operation of a clothes drier in accordance with a fourth preferred embodiment of the present invention is suspended.

FIG. 5 represents a time chart for illustrating an operation performed when a clothes drier including a clothes drying apparatus in accordance with a fourth preferred embodiment of the present invention is suspended. Since a basic operation and configuration of the clothes drier are the same as those of the first preferred embodiment, a detailed description thereof will be omitted.

Referring to FIG. 5, in case the drying operation is suspended, controller 19 stops compressor 22 after a second certain delay time period t2.

In case the drying operation is suspended, compressor 22 stops after the second certain time period t2, so that a frequent stop of compressor 22 can be prevented and a load on compressor 22 can be reduced, thereby reducing the effect of the suspension of the drying operation.

(Fifth Preferred Embodiment)

Figure 6A:
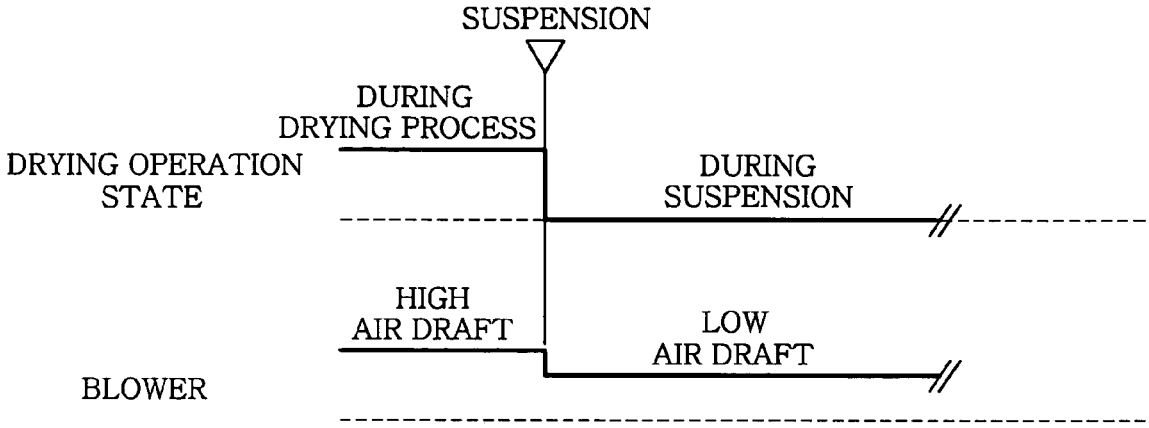
FIG. 6A presents a time chart showing an operation for reducing an air draft when a drying operation of a clothes drier in accordance with a fifth preferred embodiment of the present invention is suspended.
Figure 6B:
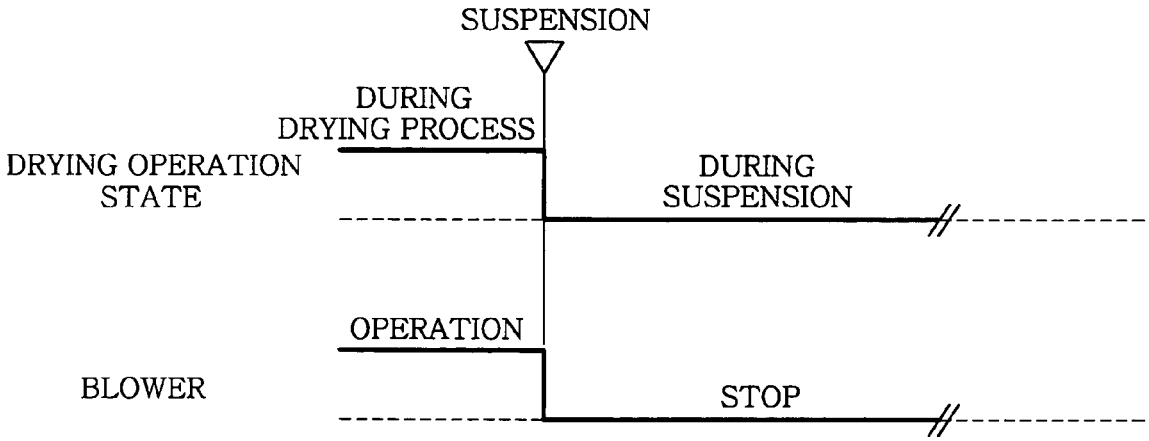
FIG. 6B represents a time chart depicting an operation for stopping blowing.

FIGS. 6A and 6B offer a time chart depicting an operation performed when a drying operation of a clothes drier including a clothes drying apparatus in accordance with a fifth preferred embodiment of the present invention is suspended. Since a basic operation and configuration of the clothes drier are the same as those of the first preferred embodiment, a detailed description thereof will be omitted.

FIG. 6A presents a time chart showing an operation in which controller 19 reduces an air draft of blower 15 in case a drying operation is suspended, and FIG. 6B represents a time chart showing an operation in case of stopping blowing.

In case compressor 22 stops or operates, if blower 15 stops or an air draft thereof is reduced, a decrease in a temperature of heat radiator 21 of heat pump mechanism 25, which is caused by air as a heat exchange medium, is slight. Therefore, after the drying operation is resumed, it is possible to allow the temperature of warm air to rapidly return.

(Sixth Preferred Embodiment)

Figure 7A:
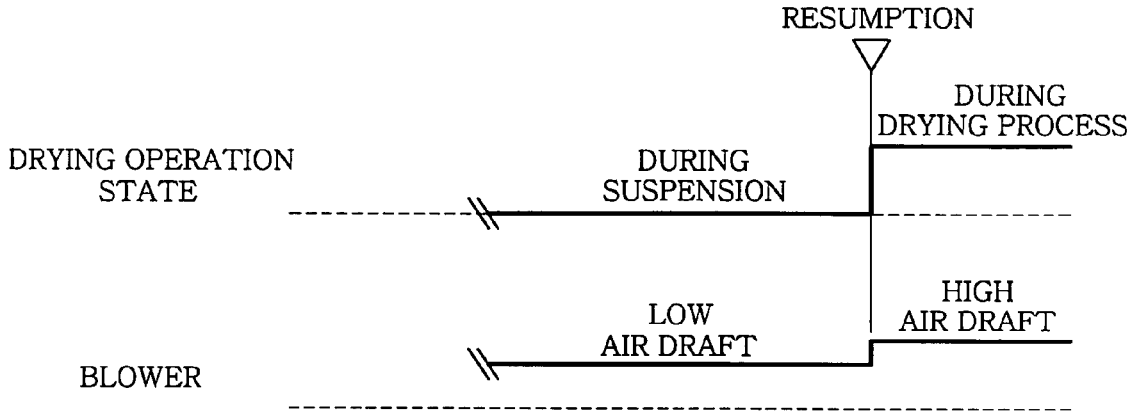
FIG. 7A offers a time chart describing an operation for increasing an air draft when a drying operation of a clothes drier in accordance with a sixth preferred embodiment of the present invention is suspended, and FIG. 7B sets forth a time chart illustrating an operation for starting blowing.
Figure 7B:
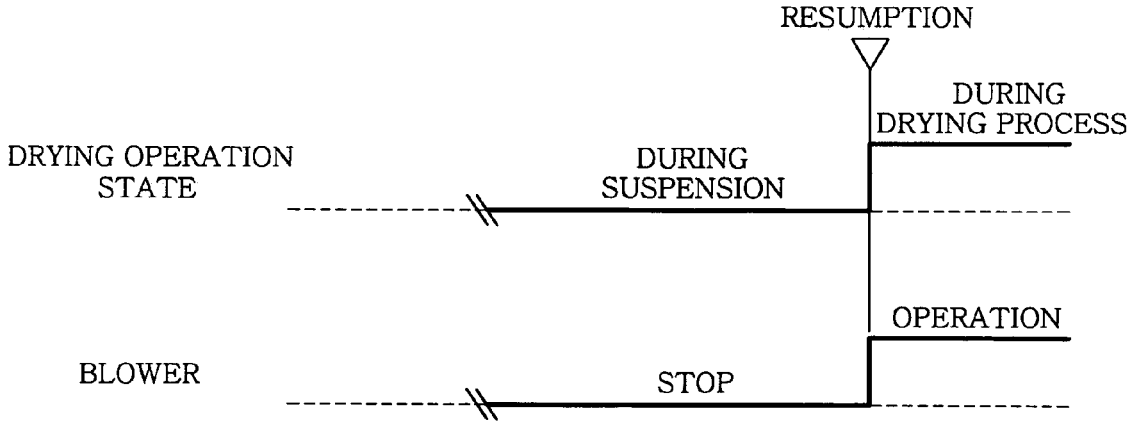

FIGS. 7A and 7B provide a time chart describing an operation performed when a drying operation of a clothes drier including a clothes drying apparatus in accordance with a sixth preferred embodiment of the present invention is suspended. Since a basic operation and configuration of the clothes drier are the same as those of the first preferred embodiment, a detailed description thereof will be omitted.

FIG. 7A shows a time chart illustrating an operation in which controller 19 increases an air draft of blower 15 in case a drying operation is resumed, and FIG. 7B represents a time chart illustrating an operation in case of starting blowing.

Once compressor 22 operates, an operation of blower 15 is restarted or an air draft thereof is increased, so that it is possible to rapidly return to the normal state after the drying operation is resumed.

(Seventh Preferred Embodiment)

Figure 8A:
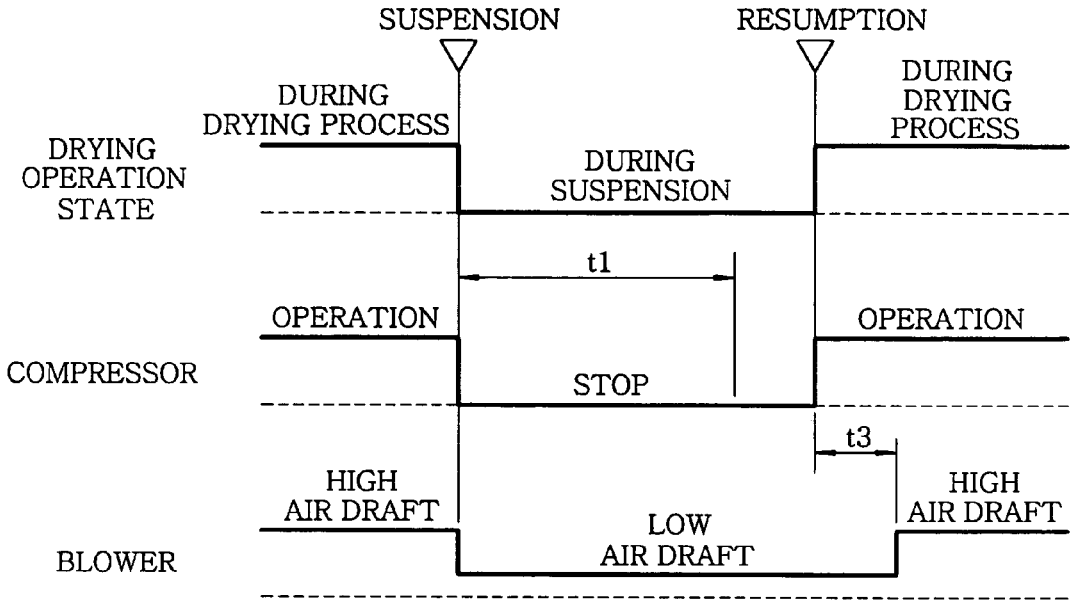
FIG. 8A is a time chart showing an operation for increasing an air draft when a drying operation of a clothes drier in accordance with a seventh preferred embodiment of the present invention is suspended.
Figure 8B:
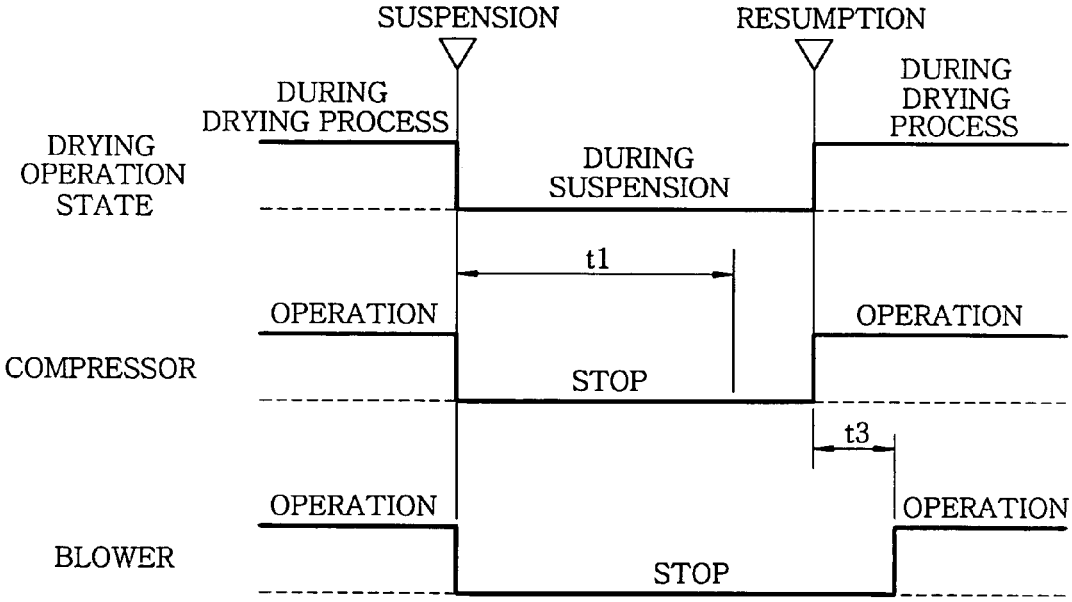
FIG. 8B shows a time chart describing an operation for starting blowing.

FIGS. 8A and 8B is a time chart describing an operation performed when a drying operation of a clothes drier including a clothes drying apparatus in accordance with a seventh preferred embodiment of the present invention is suspended. Since a basic operation and configuration of the clothes drier are the same as those of the first preferred embodiment, a detailed description thereof will be omitted.

FIG. 8A illustrates a time chart showing an operation in which controller 19 increases an air draft of blower 15 after a third certain delay time period t3 in case a drying operation is resumed, and FIG. 8B shows a time chart showing an operation in case of restarting blowing after the third certain delay time period t3.

Since an operation of blower 15 or an increase in an air draft thereof is delayed, and then, carried out after an operation of compressor 22 is resumed, a flow rate of air as a heat exchange medium becomes small and, thus, a heat radiation of heat pump mechanism 25 is reduced. As a result, a temperature of heat radiator 21 can rapidly increase, which results in a rapid return to the normal state after the drying operation is resumed.

Further, although FIGS. 8A and 8B show a single exemplary combination of operations of compressor 22 and blower 15 during the suspension of the drying operation, it is not limited to the illustrated combination.

(Eighth Preferred Embodiment)

Figure 9A:
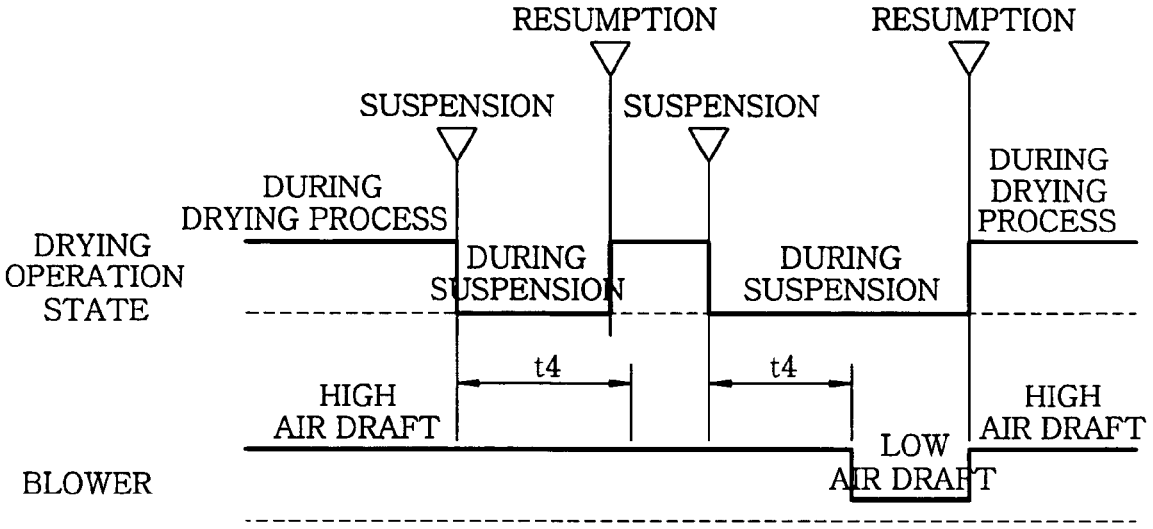
FIG. 9A presents a time chart illustrating an operation for reducing an air draft when a drying operation of a clothes drier in accordance with an eighth preferred embodiment of the present invention is suspended.
Figure 9B:
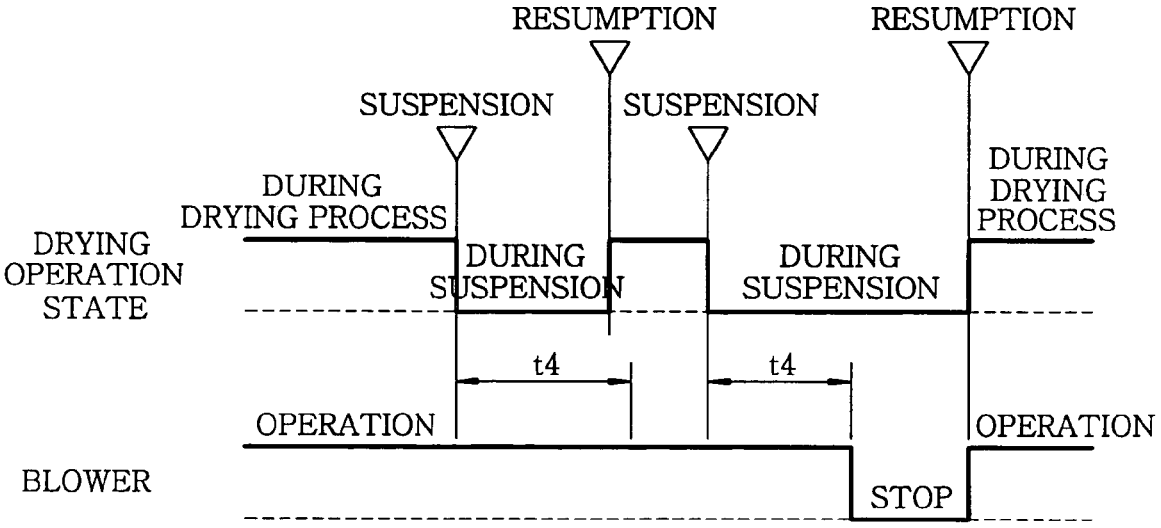
FIG. 9B represents a time chart depicting an operation for stopping blowing.

FIGS. 9A and 9B sets forth a time chart describing an operation performed when a drying operation of a clothes drier including a clothes drying apparatus in accordance with an eighth preferred embodiment of the present invention is suspended. Since a basic operation and configuration of the clothes drier are the same as those of the first preferred embodiment, a detailed description thereof will be omitted.

FIG. 9A shows a time chart illustrating an operation in which controller 19 reduces an air draft of blower 15 after a fourth certain delay time period t4 in case a drying operation is suspended, and FIG. 9B depicts a time chart illustrating an operation in case of stopping blowing.

By providing the fourth certain delay time period t4, it is possible to prevent a frequent change of the air draft, which is caused by a frequently repeated suspension of the drying operation. Thus, a change in a refrigerating cycle of heat pump mechanism 25, which is accompanied by an air draft change related to a heat radiation and a heat absorption, is reduced, thereby enabling a reduction of a frequent load change on compressor 22.

In the above-described example, the air draft of blower 15 immediately increases in case the drying operation is resumed. However, the air draft can increase after a certain time period without being limited thereto.

(Ninth Preferred Embodiment)

Figure 10A:
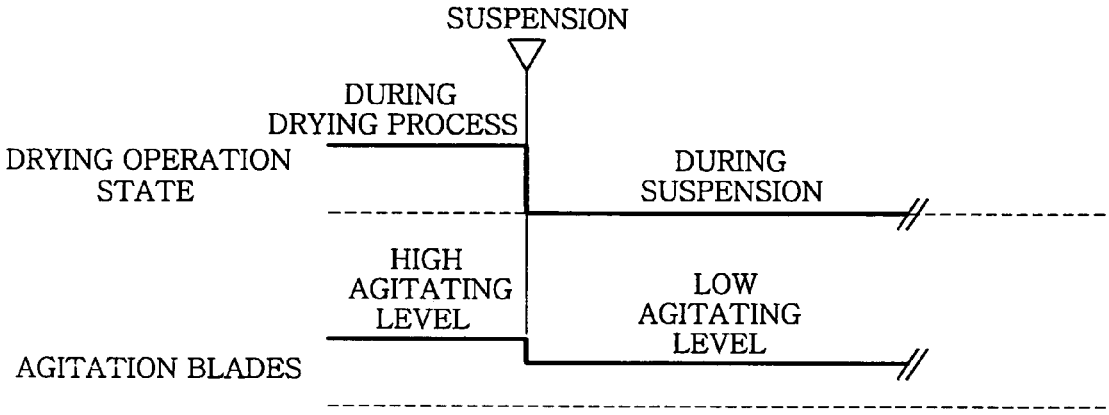
FIG. 10A provides a time chart showing an operation for reducing an agitating level when a drying operation of a clothes drier in accordance with a ninth preferred embodiment of the present invention is suspended.
Figure 10B:
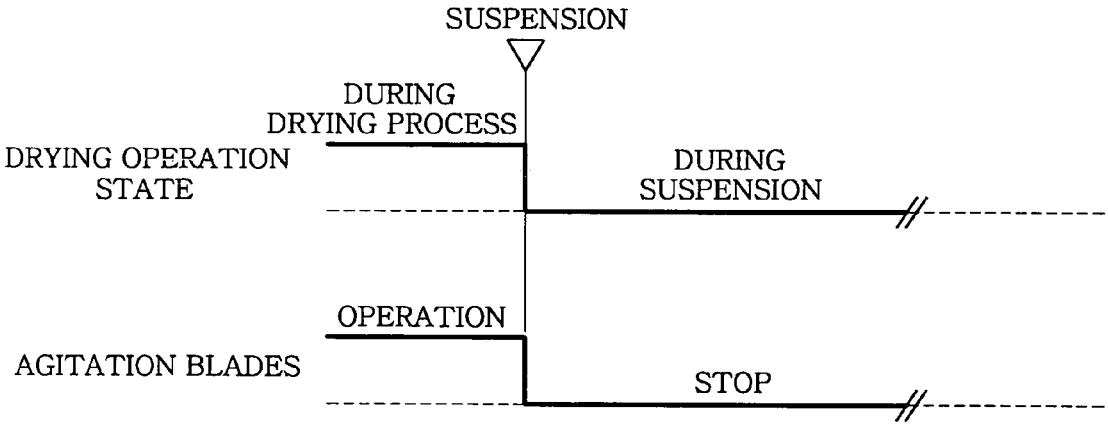
FIG. 10B is a time chart illustrating an operation for stopping agitating.

FIGS. 10A and 10B offer a time chart describing an operation performed when a drying operation of a clothes drier including a clothes drying apparatus in accordance with a ninth preferred embodiment of the present invention is suspended. Since a basic operation and configuration of the clothes drier are the same as those of the first preferred embodiment, a detailed description thereof will be omitted.

FIG. 10A depicts an operation in which controller 19 reduces a rotational speed of rotary drum 11 for agitating clothes 27 in rotary drum 11 serving as a drying drum and decreases an agitating level when the drying operation is suspended, and FIG. 10B describes an operation in case of stopping agitating.

By reducing the rotational speed of rotary drum 11 or stopping rotary drum 11, it is possible to easily put into and take out clothes 27 in rotary drum 11 or check a dried state when the drying operation is suspended.

(Tenth Preferred Embodiment)

Figure 11A:
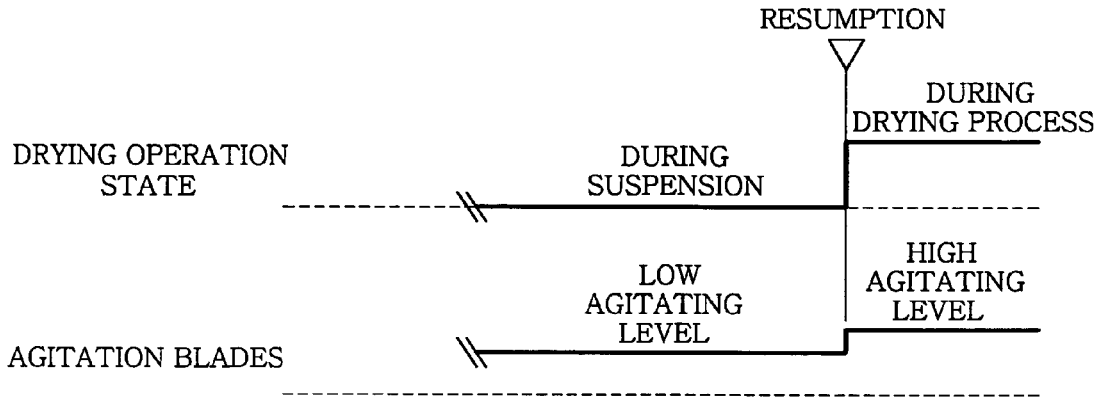
FIG. 11A presents a time chart depicting an operation for increasing an agitating level when a drying operation of a clothes drier in accordance with a tenth preferred embodiment of the present invention is suspended, and FIG. 11B describes a time chart illustrating an operation for starting agitating.
Figure 11B:
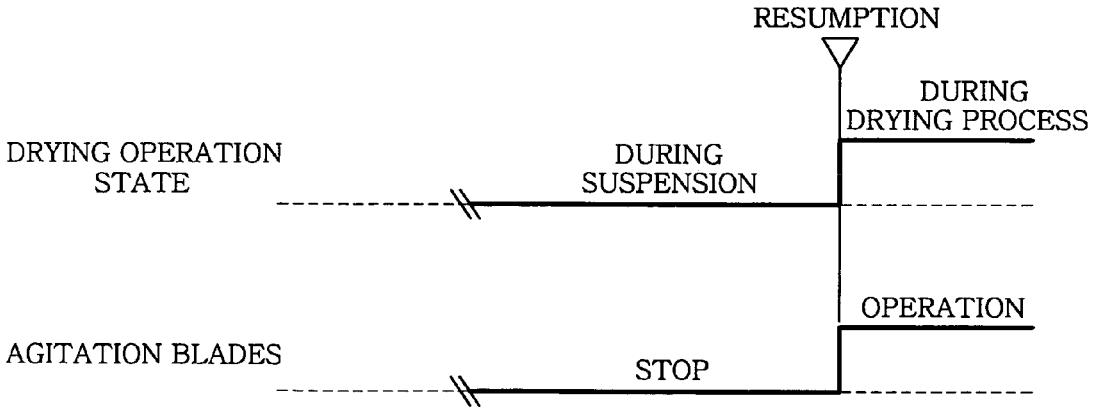

FIGS. 11A and 11B are a time chart describing an operation performed when a drying operation of a clothes drier including a clothes drying apparatus in accordance with a tenth preferred embodiment of the present invention is suspended. Since a basic operation and configuration of the clothes drier are the same as those of the first preferred embodiment, a detailed description thereof will be omitted.

FIG. 11A illustrates an operation in which controller 19 accelerates agitation blades to increase an agitating level when the drying operation is resumed, and FIG. 11B describes an operation for starting agitating.

Once clothes 27 are agitated, a contact state between clothes 27 and drying air can return to a prior state in which the drying operation was carried out and, further, the refrigerating cycle of heat pump mechanism can return to a normal state.

(Eleventh Preferred Embodiment)

Figure 12:
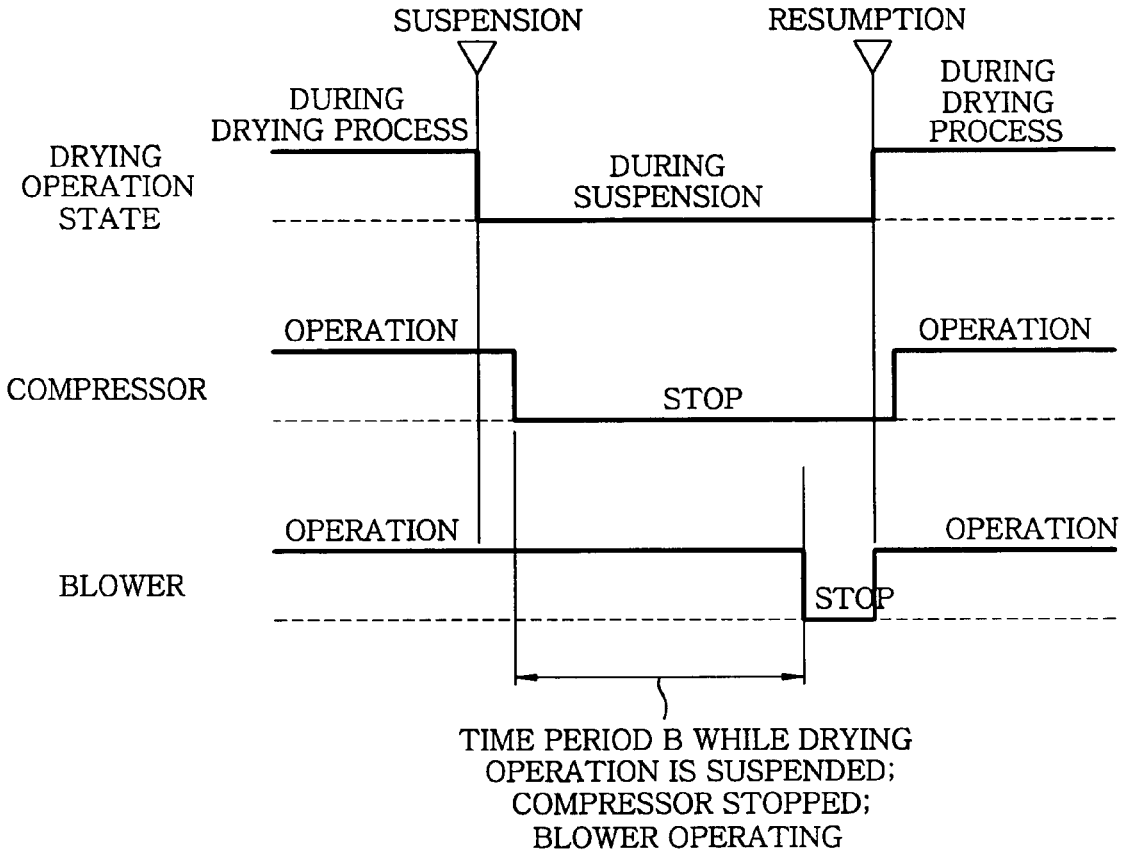
FIG. 12 offers a time chart showing an operation performed when a drying operation of a clothes drier in accordance with an eleventh preferred embodiment of the present invention is suspended.

FIG. 12 provides a time chart showing an operation performed when a drying operation of a clothes drier including a clothes drying apparatus in accordance with an eleventh preferred embodiment of the present invention is suspended. Since a basic operation and configuration of the clothes drier are the same as those of the first preferred embodiment, a detailed description thereof will be omitted.

Referring to FIG. 12, controller 19 provides a time period B in which compressor 22 stops and blower 15 operates in case the drying operation is suspended.

By making air draft into heat pump mechanism 25 with the operation of blower 15 during the stop of compressor 22, it is possible to more rapidly reduce a pressure difference of the coolant after compressor 22 stops. Further, since the pressure difference of the coolant is reduced in restarting compressor 22 in case the drying operation is resumed, a load on compressor 22 can be reduced and, at the same time, the drying process can also be carried out during the suspension of the drying operation by using residual heat of the drying air.

Further, such operation can provide the same effects regardless of an operation state of the agitation blades.

(Twelfth Preferred Embodiment)

Figure 13:
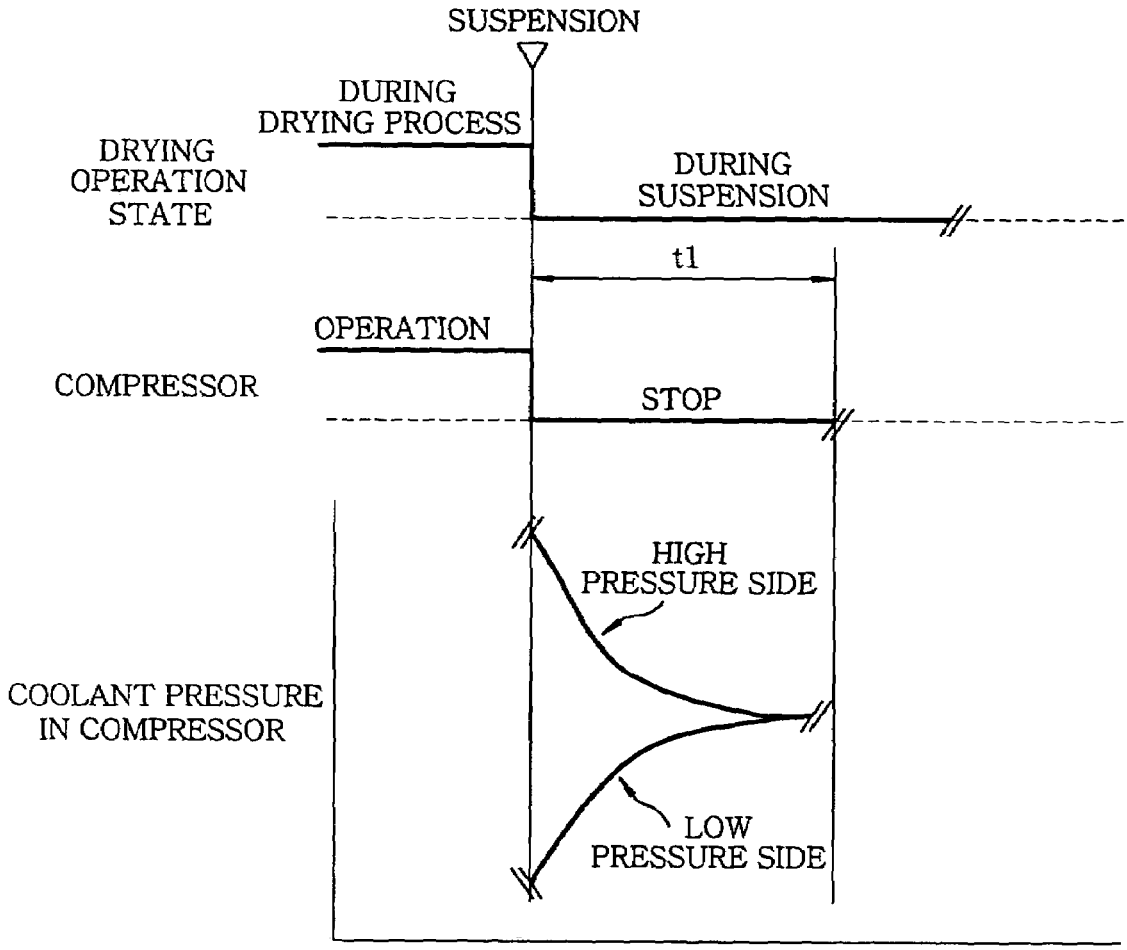
FIG. 13 represents a time chart illustrating a pressure change of a coolant during a certain time period when a compressor of a clothes drier in accordance with a twelfth preferred embodiment of the present invention is suspended.

FIG. 13 illustrates a time chart depicting an operation performed when a drying operation of a clothes drier including a clothes drying apparatus in accordance with a twelfth preferred embodiment of the present invention is suspended. Since a basic operation and configuration of the clothes drier are the same as those of the first preferred embodiment, a detailed description thereof will be omitted.

Referring to FIG. 13, the first certain delay time period t1 is set to be longer than a time period to balance a high pressure side and a low pressure side of the coolant of compressor 22, which is specifically about three minutes. However, such pressure balancing time changes depending on a configuration and/or a capability of the heat pump mechanism and generally ranges from 30 seconds to five minutes. Since a certain delay time period of the compressor is provided in restarting the compressor in case the drying operation is resumed, the pressure difference of the coolant can be reduced, thereby reducing the load on the compressor.

(Thirteenth Preferred Embodiment)

In a thirteenth preferred embodiment, compressor 22 shown in FIG. 1 compresses a coolant in a cylinder in a reciprocating or a rotary type by rotating a DC motor. A compression capability is controlled in a manner that a rotation number of the DC motor is varied by inverter circuit 29 provided in controller 19.

By gradually increasing or reducing the compression capability of the compressor, it is easy to reduce the load on the compressor when it starts or stops.

(Fourteenth Preferred Embodiment)

Figure 14:
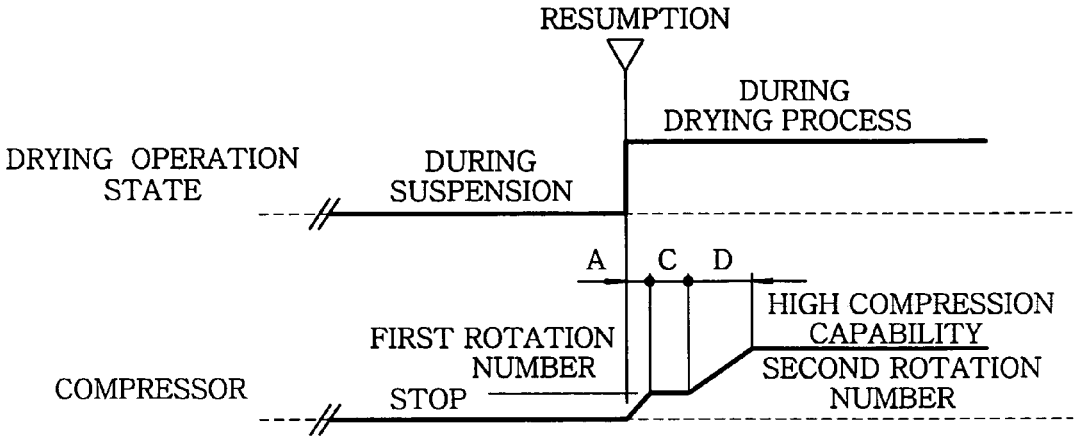
FIG. 14 shows a time chart illustrating an increase of a compression capability of a compressor when a drying operation of a clothes drier in accordance with a fourteenth preferred embodiment of the present invention is resumed.

FIG. 14 shows a time chart illustrating an operation in which a drying operation of a clothes drier including a clothes drying apparatus in accordance with a fourteenth preferred embodiment of the present invention is resumed. Since a basic operation and configuration of the clothes drier are the same as those of the first preferred embodiment, a detailed description thereof will be omitted.

Referring to FIG. 14, controller 19 increases the compression capability during a certain time period in operating compressor 22 in case the drying operation is resumed. In a time period A, compressor 22 is accelerated to a first certain rotation number at a first acceleration within a certain time period; in a time period C, the first certain rotation number is maintained for a certain time period; and in a time period D, compressor 22 is accelerated to a second certain rotation number at a second acceleration within a certain time period.

When compressor 22 is started, the load on compressor 22 can be reduced by gradually increasing the rotation number from zero as in the time period A instead of immediately starting rotating at a constant speed of the second certain rotation number, which results in a more smooth starting. Further, by maintaining the first certain rotation number for the time period C, negative pressure at the low pressure side can be prevented, so that a circulation of the coolant becomes stable. Furthermore, in the time period D, the first certain rotation number is increased to an ultimately desired rotation number (the second certain rotation number). As a result, the load on compressor 22 is reduced and, therefore, the desired compression capability can be achieved by smoothly and stably increasing the rotation number.

(Fifteenth Preferred Embodiment)

Figure 15:
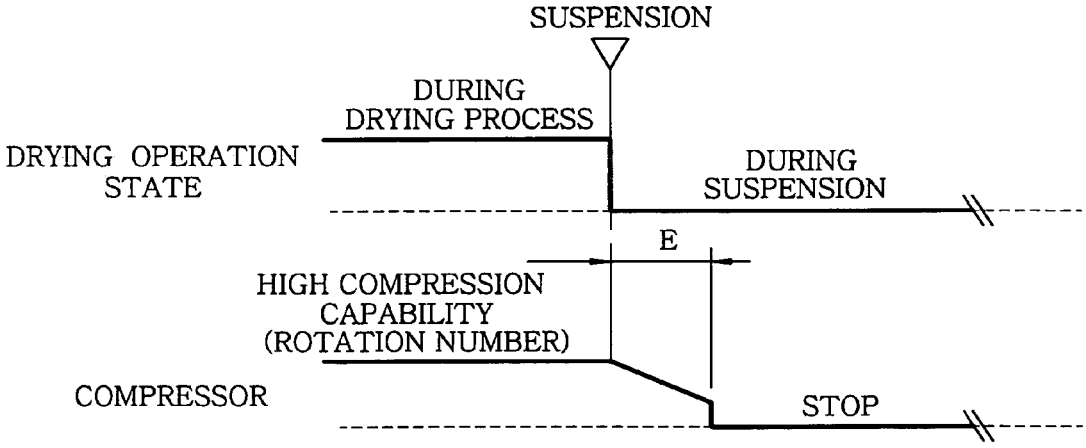
FIG. 15 depicts a time chart showing a reduction of a compression capability of a compressor when a drying operation of a clothes drier in accordance with a fifteenth preferred embodiment of the present invention is suspended.

FIG. 15 provides a time chart illustrating an operation in which a drying operation of a clothes drier including a clothes drying apparatus in accordance with a fifteenth preferred embodiment of the present invention is suspended. Since a basic operation and configuration of the clothes drier are the same as those of the first preferred embodiment, a detailed description thereof will be omitted.

Referring to FIG. 15, in case the drying operation is suspended, controller 19 reduces the compression capability during a certain time period in stopping compressor 22.

In case the drying operation is suspended, a time period E is provided in stopping compressor 22, thereby gradually reducing a rotation number for a certain deceleration time period in stopping compressor 22. Therefore, it is possible to prevent a pressure of a high pressure side from increasing due to an abrupt stop. And also, even if the drying operation is repeatedly suspended and resumed during a short time period, it is possible to rapidly and smoothly return to a normal state from the decelerated state.

(Sixteenth Preferred Embodiment)

Figure 16:
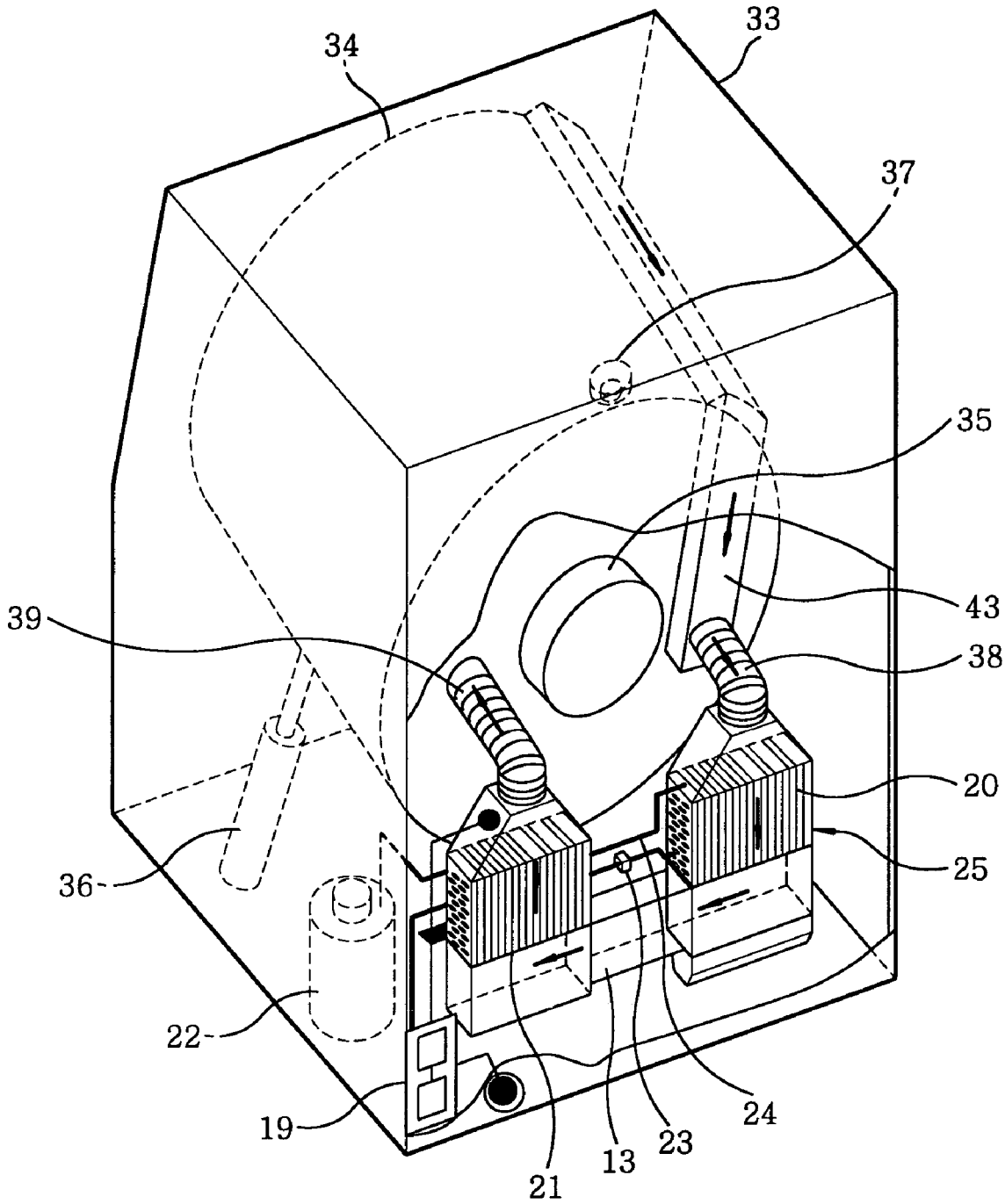
FIG. 16 presents a partially cutaway perspective view of a washing and drying machine in accordance with a sixteenth preferred embodiment of the present invention.
Figure 17:
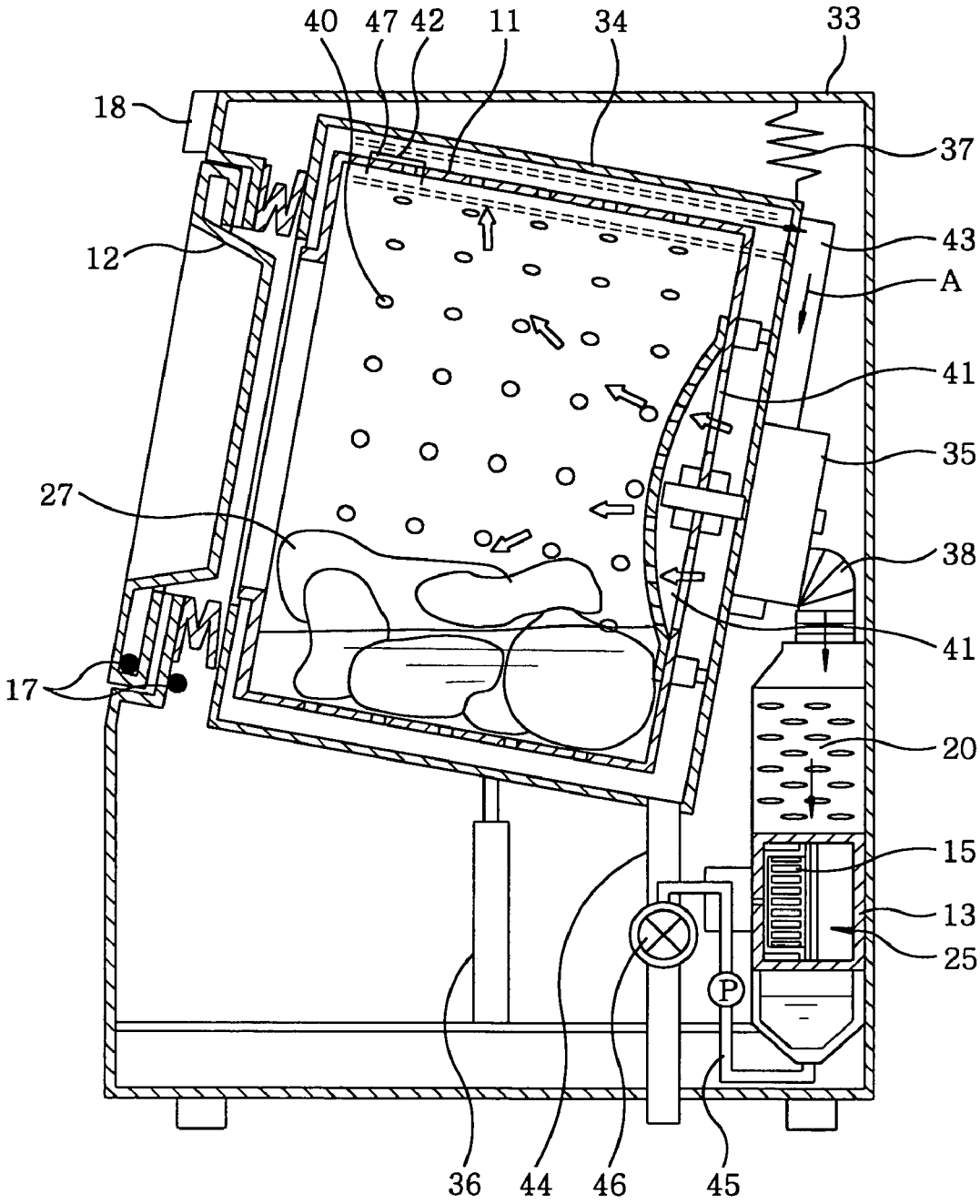
FIG. 17 illustrates a side sectional view of the washing and drying machine in accordance with the sixteenth preferred embodiment of the present invention.
Figure 18:
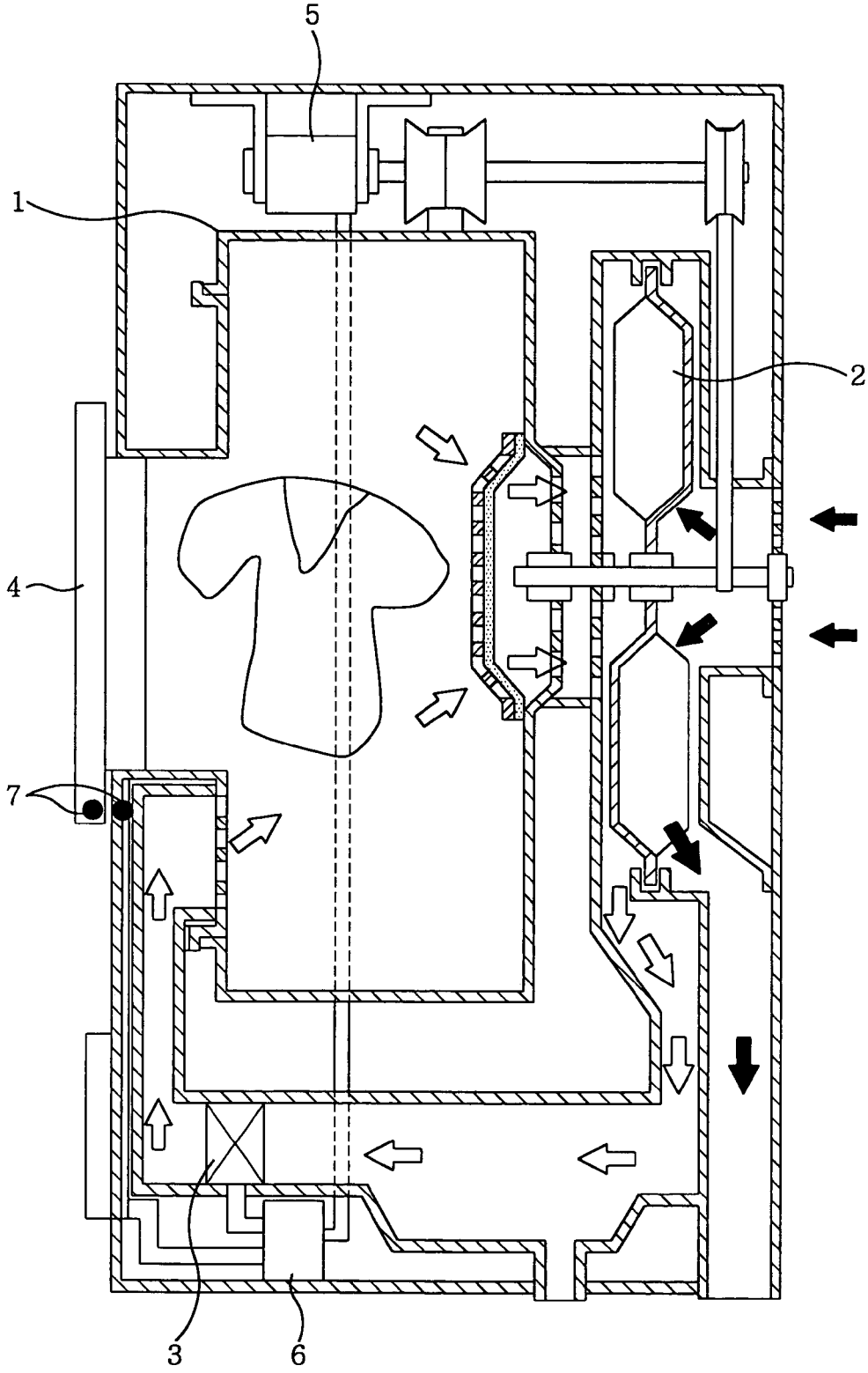
FIG. 18 (PRIOR ART)
FIG. 18 provides a side sectional view of a conventional clothes drier.

FIGS. 16 and 17 present a washing and drying machine including a clothes drying apparatus in accordance with a sixteenth preferred embodiment of the present invention. FIG. 16 represents a partially cutaway perspective view of the washing and drying machine, and FIG. 17 illustrates a side sectional view of the washing and drying machine. Parts identical with those of the first preferred embodiment are designated by the same reference numerals.

Referring to FIGS. 16 and 17, there is illustrated washing and drying machine main body 33 having therein washing tub 34 and motor 35. Washing tub 34 supported by suspensions 36 provided at both sides thereof and upper suspension 37 is attached to washing and drying machine main body 33.

There is provided heat pump mechanism 25 including heat radiator 21 for radiating heat of a coolant at a high pressure and a high temperature after the coolant is compressed by compressor 22; throttle unit 23 having an expansion valve or a capillary valve, for depressurizing the high-pressure coolant; and heat absorber 20 for absorbing heat from the surroundings by using the depressurized low-pressure coolant, compressor 22, heat radiator 21, throttle unit 23 and heat absorber 20 being sequentially connected to each other by pipeline 24 to allow the coolant to be circulated.

Air path 13 for flowing drying air is configured to connect heat absorber 20 for cooling the drying air and heat radiator 21 for heating the drying air. Washing tub 34 and air path 13 are connected by flexible hoses 38 and 39. Air path 13 is provided with blower 15. Rotary drum 11 serving as a drying drum and agitation blades is attached inside washing tub 34 while being directly connected to a shaft of motor 35. Door 12 for loading clothes 27 is provided at a position corresponding to a front opening portion of washing tub 34 and rotary drum 11.

Provided at a sidewall and a bottom surface portion of rotary drum 11 are hole 40 and opening 41 for letting washing water and/or drying air in and out. Opening 42 is disposed at an inner wall of washing tub 34 and connects an air channel of washing tub 34 and duct 43. Lint filter 47 is provided at opening 42. Wash water drain 44 for removing drain water in washing process is connected to condensation water drain 45 for removing condensed water generated in heat absorber 20 during the drying process. Further, wash water drain 44 is provided with water drain valve 46 for opening/closing a passageway.

Opening/closing detector 17 for detecting an opening/closing of door 12 has, e.g., a magnet adhered to door 12 and a reed switch provided as a magnetic sensor at drier main body 33, and detects the opening/closing of door 12 based on a change of magnetism due to a movement of the magnets. In case door 12 is opened during a drying operation, if rotary drum 11 serving as agitation blades is rotating, it is difficult to put into and take out clothes 27. Therefore, in case door 12 is opened during the drying operation, the drying operation is suspended. Further, in case door 12 is closed, the drying operation is resumed.

Further, a manipulating unit is provided with drying operation stop switch 18 together with various mode setting switches, e.g., a power switch, a start/stop switch of the drying operation, wherein the drying operation is suspended and resumed by manipulating drying operation stop switch 18.

In case the drying operation is suspended, controller 19 stops compressor 22 immediately or after a delay time period and/or stops blower 15 or reduces an air draft thereof. In case the drying operation is resumed, controller 19 operates compressor 22 after a certain time period has elapsed since compressor 22 had stopped and, further, operates blower 15 immediately or after a delay time period or increases an air draft thereof. Further, in case the drying operation is suspended, rotary drum 11 serving as agitation blades stops or a rotation number thereof is reduced.

As described above, since a certain delay time period is provided in case compressor 22 is stopped and, further, compressor 22 and/or blower 15 operates after a certain time period in case the drying operation is suspended, it is possible to avoid a frequent change of a load on compressor 22 during a short time period, which is caused by suspending and resuming the drying operation. In the meantime, in case the drying operation is resumed, blower 15 operates after compressor 22 operates, thereby enabling a rapid increase of a refrigerating cycle. In other words, a pressure difference between a high pressure and a low pressure of the coolant rapidly becomes a certain value, so that a temperature of the drying air rapidly reaches a certain temperature. In addition, in case the drying operation is suspended, it is possible to easily put into and take out clothes in the drying drum and/or check a dried state by stopping the agitation blades or reducing an agitating level.

As described above, in the clothes drying apparatus in accordance with the present invention, since a certain delay time period is provided in case the compressor is stopped, and, further, the compressor and/or the blower operates after a certain time period in case the drying operation is suspended, it is possible to avoid a frequent change of a load on the compressor during a short time period, which is caused by suspending and resuming the drying operation. In the meantime, in case the drying operation is resumed, the blower operates after the compressor operates, thereby enabling a rapid increase of a refrigerating cycle. Accordingly, the present invention can be applied to a clothes drying apparatus, a washing and drying machine or the like including a heat pump mechanism.

While the invention has been shown and described with respect to the preferred embodiments, it will be understood by those skilled in the art that various changes and modifications may be made without departing from the spirit and scope of the invention as defined in the following claims.

What is claimed is:

1. A clothes drying apparatus comprising:

a heat pump mechanism including a compressor, a heat radiator for radiating heat of a compressed coolant at a high pressure and a high temperature, a throttle unit fordepressurizing the high-pressure coolant, and a heat absorber for absorbing heat from surroundings by using the depressurized low-pressure coolant, wherein the compressor, the heat radiator, the throttle unit and the heat absorber being connected to each other by a pipeline to allow the coolant to be circulated;

a rotary drum rotatably driven by a motor;

an air path for guiding drying air to the rotary drum, the heat radiator, and a drying drum having therein clothes;

a blower for blowing the drying air to the air path by a separate motor which is different from the motor driving the rotary drum;

a controller for controlling driving of the compressor; and a drying operation stop switch for resuming and suspending a drying operation, wherein the controller operates the blower, the rotary drum, and the compressor during the drying operation, and reduces an air draft of the blower or stops blowing and stops the rotary drum and the compressor in case the drying operation is suspended by manipulating the drying operation stop switch; and in case of resuming the drying operation by manipulating the drying operation stop switch, the controller enables the blower to increase its air draft or start blowing and operates the rotary drum, and enables the compressor to be operated only after a delay time period t1 has elapsed since the compressor was stopped.

2. The clothes drying apparatus of claim 1, wherein the controller stops the compressor in case the drying operation is not resumed by manipulating the drying operation stop switch until a delay time period t2 elapses, the delay time period t2 being from time when the drying operation is suspended by manipulating the drying operation stop switch to time when the compressor operation is stopped.

3. The clothes drying apparatus of claim 1, wherein the controller increases the air draft of the blower or starts blowing after a delay time period t3 has elapsed since the drying operation was resumed by manipulating the drying operation stop switch, the delay time period t3 being from time when the compressor is operated by resuming the drying operation with manipulation of the drying operation stop switch to time when a temperature of the heat radiator increases up to a target value with the operation of the compressor.

4. The clothes drying apparatus of claim 1, wherein the controller reduces the air draft of the blower or stops blowing after a delay time period t4 has elapsed since the drying operation was suspended by manipulating the drying operation stop switch, the delay time period t4 being from time when the drying operation is suspended by manipulating the drying operation stop switch to time when the air draft of the blower is reduced or blowing is stopped.

5. The clothes drying apparatus of claim 1, wherein the controller makes the blower keep blowing until a pressure difference of the coolant of the compressor becomes a value at which a load generated by resuming the compressor can be reduced when the drying operation is suspended by manipulating the drying operation stop switch.

6. The clothes drying apparatus of claim 1, wherein the delay time period t1 is longer than a time to balance a high pressure side and a low pressure side of the coolant of the compressor.

7. The clothes drying apparatus of claim 1, wherein the controller is capable of varying a compression capability of the compressor.

8. The clothes drying apparatus of claim 7, wherein the controller increases the compression capability during a predetermined time period when starting operating the compressor in case of resuming the drying operation.

9. The clothes drying apparatus of claim 7, wherein the controller reduces the compression capability during a preset time period before stopping the compressor in case of suspending the drying operation.

* * * * *